United States Patent [19]

Oliver et al.

[11] 4,158,952

[45] Jun. 26, 1979

[54] PADLOCK WITH REMOVABLE TOP CLOSURE

[75] Inventors: Roy N. Oliver; Glenn K. Hartman, both of Salem; William A. Krupicka, Roanoke, all of Va.

[73] Assignee: Medeco Security Locks, Inc., Salem, Va.

[21] Appl. No.: 924,584

[22] Filed: Jul. 14, 1978

[51] Int. Cl.[2] ..... E05B 67/02; E05B 67/06

[52] U.S. Cl. ..... 70/52; 70/53; 70/386; 70/367

[58] Field of Search ..... 70/38 R, 38 A, 38 B, 70/38 C, 52, 39, 53, 386, 367–369

[56] References Cited

U.S. PATENT DOCUMENTS

| | | | |
|---|---|---|---|
| 1,849,775 | 3/1932 | Thomas | 70/53 |
| 2,460,615 | 2/1949 | Andrew | 70/386 |
| 3,710,603 | 1/1973 | Miller | 70/38 A |
| 4,063,435 | 12/1977 | Oliver | 70/38 A |

*Primary Examiner*—Robert L. Wolfe

*Attorney, Agent, or Firm*—Sughrue, Rothwell, Mion, Zinn and Macpeak

[57] ABSTRACT

A padlock of the type having a removable locking plug or cylinder capable of being removed from the top through a top opening in the lock case, also has a cap for the top opening. This cap is locked into the padlock case by a loose ball fitting in a groove in the cap and in the case. This cap locking ball is in addition to two other conventional locking balls used to lock the shackle in one conventional type padlock. The shackle is retained by another ball which is carried by a shackle leg and cooperates with another groove in the case. The shackle locking ball is placed in or out of locking position by adjustment of a set screw in the shackle leg.

5 Claims, 6 Drawing Figures

PADLOCK WITH REMOVABLE TOP CLOSURE

BACKGROUND OF THE INVENTION

1. Field of the Invention

This invention relates to improvements in removable closures for top opening padlocks of the type where the padlock opens at the top to allow access for changing a removable locking cylinder or plug, and also in improvements in removably retaining the shackle in the case.

2. Description of the Prior Art

The purpose of all locks, including padlocks, is to provide security, In this connection, it is known to provide padlocks with high security lock cylinders which are removable. One such arrangement is commercially available from Medeco Security Locks, Inc., in Salem, Virginia. It includes an arrangement for interchanging the lock cylinder through a top opening in the padlock body in accordance with prior U.S. Pat. No. 4,063,435, granted Dec. 20, 1977. There are other high security padlocks known in the prior art and available on the market which have a high security locking cylinder removable through the top of the padlock body; e.g., padlocks made by Sargent & Greenleaf, Inc., in accordance with Harry C. Miller's U.S. Pat. No. 3,713,309. Moreover, many prior art padlocks use balls to lock the shackle.

There is need, however, for a device that is easier and more economical to manufacture than that known in the prior art while having the same high security features with regard to removability of the plug from the top of the padlock. This invention provides such a construction.

SUMMARY OF THE INVENTION

In this invention, a padlock case has a cap for a top opening in the case which provides for access to a removable cylinder lock or plug. The padlock includes the usual shackle, and the locking of the shackle legs is by spherical balls as is known in the art. One unique concept of this invention is utilizing a third locking ball to lock in the closure in the top of the padlock, thus reducing the amount of machining and simplifying the construction from that known in the prior art. Another unique concept is the use of another ball with an adjustable screw to control the removability of the shackle when in the unlocked condition.

DETAILED DESCRIPTION OF THE PREFERRED EMBODIMENT

Figure 1:
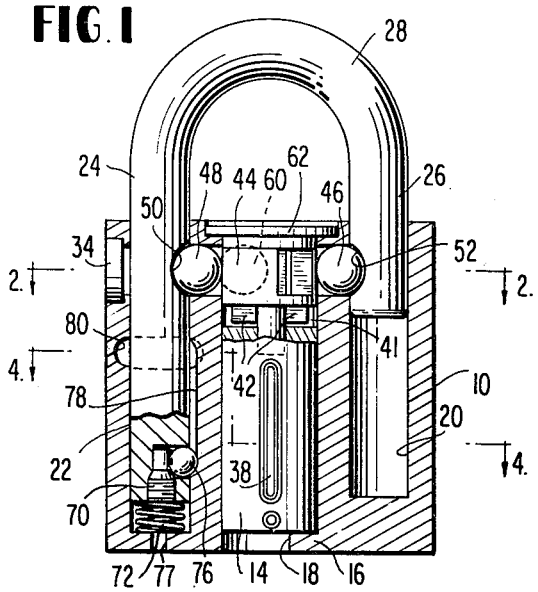
FIG. 1 is a side transverse elevational view of the padlock of this invention.

A padlock case 10 has a top opening 12 therein for receiving a locking cylinder 14. This locking cylinder may be of a commercially available type, such as manufactured by Medeco Security Locks, Inc. of Salem, Virginia. The bottom surface 16 of the case is solid, except for a key opening area 18, so that a key may be inserted to operate the locking plug or cylinder 14. The padlock case 10 also has openings 20 and 22 for legs 26 and 24 of shackle 28. The padlock case further has an opening 30 in one side thereof for a plug 34 and an access opening in bottom.

The key operated locking cylinder 14 has a side bar spline 38 on the side surface thereof for cooperating with a vertical groove 40 in the padlock case. At the upper end of the lock cylinder 14 is a groove 41 for cooperating with tongues 42 of an actuator 44. Thus, when the cylinder lock is rotated by means of the key, the actuator 44 can be rotated to position it so that the shackle legs may be locked or unlocked. More specifically, a pair of locking balls 46 and 48 cooperate with semicircular grooves 50 and 52 in the inside of shackle legs 24 and 26, respectively to provide the locking function depending upon the position of the actuator.

Figure 2:
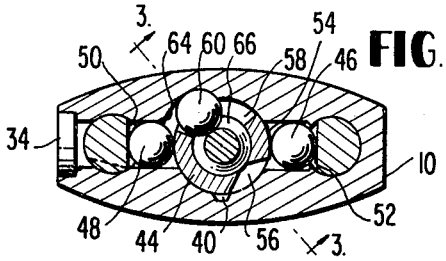
FIG. 2 is a sectional view taken along line 2—2 of FIG. 1 showing the components in the locked position.

In the locked condition of the shackle as shown in FIG. 1, an outer wall 54 of the actuator holds the balls outwardly so that they fit into grooves 50 and 52 and prevent the shackle legs from being lifted. The actuator wall, however, has openings 56 and 58, FIG. 2, so that when the actuator 44 is rotated these openings allow the balls to be forced inwardly toward the center of the lock and thus free the shackle 28 for vertical movement.

Figure 3:
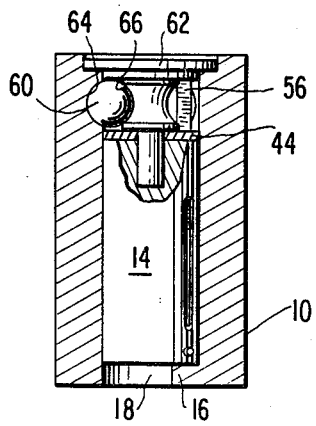
FIG. 3 is a sectional view taken along line 3—3 of FIG. 2.
Figure 5:
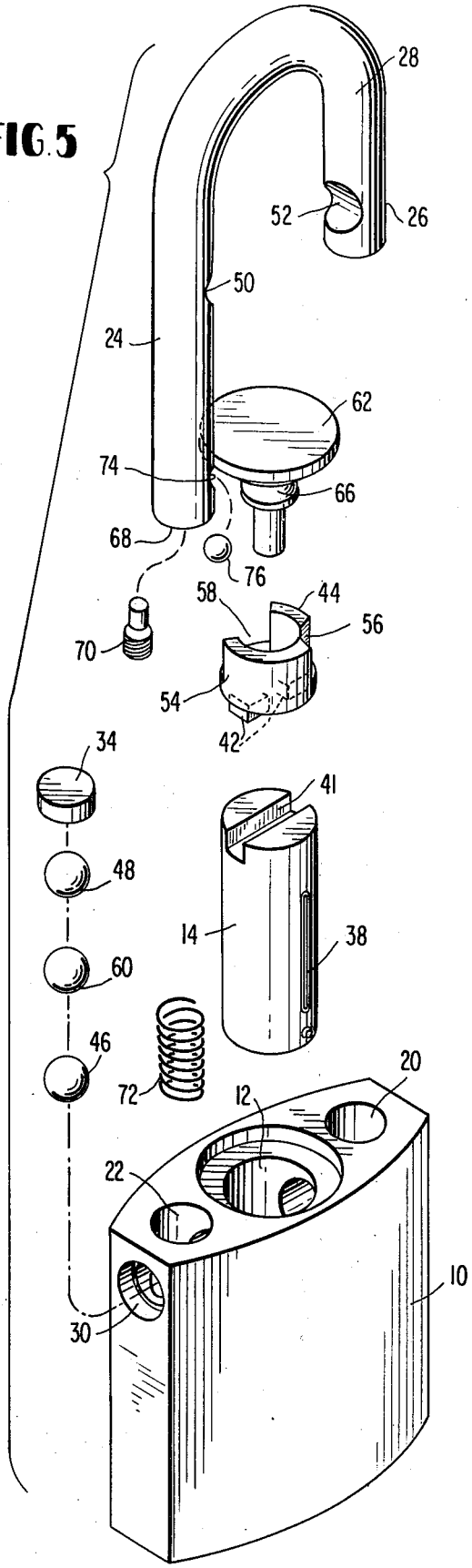
FIG. 5 is an exploded perspective view of the lock and components of this invention.

Opening 58 is wider than opening 56 to accommodate a further locking ball 60. A top closure or cap 62 extends downwardly when in place, as shown in FIG. 3, to be approximately flush or below the surface of the top of the padlock case 10. The case has an annular recess 64 for accommodating the locking ball 60 between the case and an annular groove 66 formed in the cap 62.

Figure 2A:
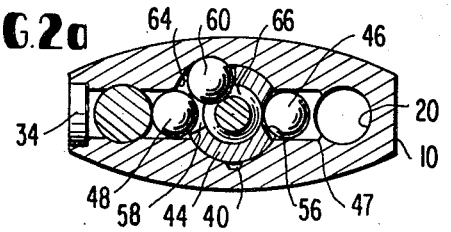
FIG. 2*a* is a sectional view similar to FIG. 2 with the components in the unlocked condition.
Figure 4:
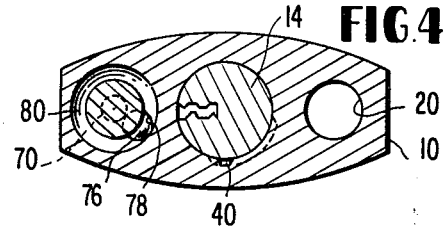
FIG. 4 is a sectional view taken along line 4—4 of FIG. 1.

When the proper key is inserted into the lock cylinder, the cylinder may be turned to turn the actuator 44 counter clockwise (see FIG. 2*a*) unit recess 56 in the actuator is lined up adjacent locking ball 48 and wider recess 58 accommodates both locking ball 46 and the cap retainer ball 60. The two locking balls can then be forced inwardly by a force on the shackle 28, and the shackle may move vertically upward and then turned. Leg 24 of the shackle has a tip end 68 carrying a set screw 70, and a side opening 74 for accommodating a ball 76 movable in vertical groove 78. A semicircular groove 80 at the top of vertical groove allows the shackle to be turned when in its outermost position. The ball 76 cooperating with the groove 80 prevents the shackle from being removed entirely when the padlock is unlocked and when the set screw 70 is in position to force the ball 76 into the groove 78. Below shackle leg 24, there is a conventional compression spring 72 to force the shackle upwardly when the lock is released.

To assemble the padlock, the lock cylinder 14 is placed in the case 10. The ball 46 is then inserted through opening 30 until it rests against lip 47 adjacent opening 20 (see FIG. 2*a*). The actuator 44 and the cap 62 are then put in place to top opening 12. The balls 48 and 60 are then inserted through opening 30, with the lock in the unlocked position (FIG. 2*a*), and the shackle 28 is installed. To install the shackle, after spring 72 is inserted, ball 76 is placed in opening 74 and set screw 70 is backed off to allow the ball to be forced inwardly. After installing the shackle the set screw 70 is turned by a tool inserted through access opening 77 to force the ball 76 into groove 78. After the shackle 28 is pushed downwardly, the lock plug 14 is turned to the locked position by the key.

To remove the lock cylinder 14 and replace it with another one, or to repair it, or other reasons, the lock is unlocked, the shackle is raised and removed completely by reversing the procedure of the preceding paragraph, the cap is removed and the other loose components and lock plug can be removed.

It is noted that even if someone attempting to breach the security of the lock were to loosen the set screw on the shackle, the lock would still remain locked. Thus, the fact that the set screw is accessible through opening 77 does not adversely affect the security of the lock. Moreover, the access opening 77 provides a drain should the lock be used outdoors and water get into it. This prevents water from freezing in the lock and causing the lock itself to freeze and be unopenable in subfreezing weather.

I claim:

1. A padlock of the type having a padlock case, a U-shaped shackle alternatively lockable in the case or extendible therefrom to unlock the padlock, a removable lock cylinder within the case and removable through a top opening in the case, and a cap for such top opening, the improvement comprising a cap retainer ball positioned between a groove in the cap and a groove in the lock case for retaining the cap when the shackle is in the case.

2. A padlock as in claim 1 further comprising an actuator member positioned between the lock cylinder and the cap, the actuator member cooperating having spaced recesses to accommodate the cap locking ball and a pair of shackle locking balls to allow the shackle locking balls to be forced inwardly when the actuator member and lock cylinder are in an unlocked position.

3. A padlock as in claim 2 wherein the actuator has two opposite openings therein, one opening to accommodate one shackle locking ball, and the other opening to accommodate the shackle locking ball and the cap retaining ball.

4. A padlock as in claim 3 wherein the shackle is retained in the lock in its unlocked position by a movable set screw and locking ball cooperating with the case.

5. A padlock of the type having a padlock case and removable shackle, the improvement in means for retaining the shackle in the padlock case when the shackle is in unlocked condition, comprising an access opening in the bottom of the case in alignment with one leg of the shackle, a set screw threadly engaged in the end of one leg of the shackle above the access opening, a ball contacted by said set screw and normally positioned in an opening in the side of the shackle leg, a deadend groove axially in the case adjacent the shackle leg for cooperating with the ball and guiding the shackle, the set screw in normal condition being threaded into the bottom of the shackle leg to force the ball outwardly into the groove and retain the shackle in the case when the shackle is in unlocked position, the set screw when backed out allowing the ball to move toward the center of the shackle leg to clear a hole for the shackle in the case and allow the shackle to be removed.

* * * * *